United States Patent [19]

Nogami et al.

[11] Patent Number: 4,732,832

[45] Date of Patent: Mar. 22, 1988

[54] ELECTROPHOTOGRAPHIC PHOTOCONDUCTOR USING ALUMINUM PHTHALOCYANINE COMPOUND IN CHARGE GENERATING LAYER

[75] Inventors: Sumitaka Nogami, Yokohama; Yoshihiko Mori; Tatsuro Iwabuchi, both of Kawasaki, all of Japan

[73] Assignee: Asahi Kasei Kogyo Kabushiki Kaisha, Osaka, Japan

[21] Appl. No.: 938,482

[22] Filed: Dec. 5, 1986

[30] Foreign Application Priority Data

| | | | |
|---|---|---|---|
| Dec. 6, 1985 | [JP] | Japan | 60-273360 |
| Jan. 31, 1986 | [JP] | Japan | 61-18042 |
| Aug. 11, 1986 | [JP] | Japan | 61-186960 |

[51] Int. Cl.[4] ..... G03G 5/14

[52] U.S. Cl. ..... 430/58; 430/78

[58] Field of Search ..... 430/78, 58; 540/140, 540/141

[56] References Cited

U.S. PATENT DOCUMENTS 4,311,775 1/1982 Regan ..... 430/78 X

*Primary Examiner*—J. David Welsh

*Attorney, Agent, or Firm*—Armstrong, Nikaido, Marmelstein & Kubovcik

[57] ABSTRACT

This invention relates to a layered photoconductor having a charge generating layer and a charge transfer layer superimposed on an electroconductive substrate, which photoconductor has as the main component of the charge generating layer an aluminum phthalocyanine derivative which is represented by the formula, $AlC_{32}N_8H(17-x)Cl_x$ (wherein $x=1.0$ to 3.0), has the loss of weight on heating of $6\pm0.5\%$ by weight, shows strong X-ray diffraction peaks at 6.7 degrees, 11.2 degrees, 16.7 degrees, and 25.6 degrees, and shows the maximum absorption of the visible absorption spectrum in a wavelength range of 640 nm to 660 nm or 750 nm to 850 nm.

The photoconductor according to this invention is highly sensitive without suffering from dispersion of performance, exhibits high sensitivity in various ranges of wavelength, and does not cause fogging in actual printing.

5 Claims, 4 Drawing Figures

ELECTROPHOTOGRAPHIC PHOTOCONDUCTOR USING ALUMINUM PHTHALOCYANINE COMPOUND IN CHARGE GENERATING LAYER

BACKGROUND OF THE INVENTION

1. Field of the Invention

This invention relates to an electrophotographic photoconductor using a specific phthalocyanine as a charge generating agent.

This invention aims to provide an electrophotographic material of excellent performance by using, as a charge generating agent, modified chlorinated aluminum phthalocyanine crystals excellent in charge generating property and by combining this charge generating agent with a charge transfer agent.

2. Description of the Prior Art

Since Carlson invented an electrophotographic photoconductor, numerous photoconductors have been developed and have been used in many fields such as copying machines, photograving machines, and printers. Particularly in recent years, these electrophotographic photoconductors are making remarkable developments in the field of printers. A multi-purpose electrophotographic photoconductor which conforms not only to the light source of a semiconductor laser but also to light sources such as, for example, a light-emitting diode and an He/Ne gas laser has been demanded.

As means of meeting this requirement, various inorganic and organic photoconductors have been proposed. As inorganic type photoconductors, amorphous silicon, selenium-tellurium compound, and selenium-arsenic compound have been known to the art. As organic type photoconductors, various materials using phthalocyanines, condensed polycyclic compounds, azo type pigments, and other coloring matters as charge generating agents and combining these charge generating agents with various charge transfer agents have been known to the art.

These photoconductors, to be suitable for light sources of semiconductor lasers or light-emitting diodes, require a charge generating agent capable of efficiently absorbing the semiconductor laser beam or the light-emitting diode beam and excellent in charge generating property.

Phthalocyanines which are one species of organic photoconductors find utility in many applications because they have an absorption wavelength range extended to a long wavelength and possess a highly satisfactory charge generating ability as compared with other photoconductors.

What is particularly noted about photoconductors using phthalocyanines is the fact that these phthalocyanines are used in the form of specific crystals as a charge generating agent.

For example, the same metal-free phthalocyanines are known to be useful in varying crystal forms such as the X form which is described in British Patent No. 1,116,553, the $\tau$ and $\eta$ forms which are shown in U.S. Pat. No. 4,507,374, and the $\alpha$ and $\beta$ forms which are described in J. Phys. Chem., 27, 3230 (1968). Also, copper phthalocyanine is known to be used in various crystal forms such as, for example, the $\epsilon$ form which is described in Japanese Patent Publication No. 1667/1977, and the $\alpha$, $\beta$, $\gamma$, $\pi$, $\chi$, and $\rho$ forms. It has been known that this difference in crystal form brings about variations of photoconductivity. In selecting from among various phthalocyanines a specific phthalocyanine for use as a charge generating agent in a photoconductor, the specific phthalocyanine must contain a crystal structure which is exactly defined and established to be effective in generating a charge in the photoconductor.

It has been known that photoconductors using, as charge generating agents, the crystals of chlorinated aluminum phthalocyanines represented by chloroaluminum phthalocyanine and chloroaluminum phthalocyanine chloride among other phthalocyanines described above are particularly useful as electrophotographic photoconductors operating with various light sources because they exhibit high spectral sensitivity to long wavelengths in the visible range in the neighborhood of 500 nm through the near-infrared range of 900 nm. For example, Ivanof Chemical Engineering Research Report (dated Feb. 2, 1972) contains in pp. 1905 to 1908 a statement which purports that chloroaluminum phthalocyanine shows photoconductivity. British Patent No. 1,268,574 discloses that polychloroaluminum phthalocyanine can be used as an electrophotographic photoconductor. It is stated in Japanese Patent Application Laid-open No. 211149/1982 and U.S. Pat. No. 4,426,434 that the aluminum phthalocyanine which is obtained by treating with a vacuum deposited solvent a film containing chloroaluminum phthalocyanine or chloroaluminum phthalocyanine chloride and which possesses a specific X-ray diffraction spectrum and infrared absorption spectrum is useful as a charge generating layer in a layered photoconductor possessing high sensitivity in the near-infrared range.

The present inventors made a study on an electrophotographic photoconductor using chloroaluminum phthalocyanine chloride represented by the formula, $AlClC_{32}N_8H_{(15.6-14.4)}Cl_{(0.4-1.6)}$, as a charge generating agent. They have consequently found that the phthalocyanine in a form merely vacuum deposited on a film or applied by dispersion of fine particles on a film possesses an insufficient charge generating ability and that this phthalocyanine, when treated with a solvent such as toluene, xylene, or chloroform which possesses affinity for phthalocyanines, gives rise to a chloroaluminum phthalocyanine chloride possessing a specific X-ray diffraction and exhibiting an excellent charge generating ability in the visible range through the near-infrared range (U.S. Pat. No. 4,444,861).

However, the performance of the photoconductor actually obtained by the procedure just described varies and constant characteristics are obtained only with difficulty. While it enjoys high sensitivity, it entails the disadvantage that it has high residual potential and induces an unwanted phenomenon of fogging in actual printing.

SUMMARY OF THE INVENTION

For the purpose of overcoming the drawbacks of the prior art described above, the inventors continued a diligent study on the behavior of transformation of chlorinated aluminum phthalocyanines. They have consequently found that the charge generating ability of the phthalocyanine is not solely governed by the crystal form of the compound and succeeded in developing novel modified crystals of chlorinated aluminum phthalocyanine represented by the formula, $AlC_{32}N_8H_{(17-x)}Cl_x$ (wherein x represents a number in the range of 1.0 to 3.0), and useful as a charge generating agent.

To be specific, the present invention provides a layered photoconductor having a charge generating layer and a charge transfer layer superimposed on an electroconductive substrate, which electrophotographic photoconductor has as a main component of the charge generating layer an aluminum phthalocyanine derivative defined by the following requirements:

(a) that the above derivative is a chlorinated aluminum phthalocyanine represented by the formula, $AlC_{32}N_8H_{(17-x)}Cl_x$ (wherein x represents a number in the range of 1.0 to 3.0), (b) that the weight on heating (the ratio of loss of weight lost by heating on a thermobalance at a temperature increasing rate of 5° C./min. from 140° to 220° C. to the weight prior to heating) is 6±0.5% by weight.

(c) that the X-ray diffraction spectrum shows strong diffraction peaks at the Bragg angles of 6.7 degrees, 11.2 degrees, 16.7 degrees, and 25.6 degrees, and (d) that the visible absorption spectrum shows the maximum absorption in a wavelength range of 640 nm or 660 nm to 750 nm to 850 nm.

In the diagrams, the curve (a) represents the data obtained from samples refined by sublimation and given no further treatment (Comparative experiment), the curve (b) the data obtained from samples treated with water only (this invention), and the curve (c) the data obtained from samples treated with organic solvents containing 2 molecules of water per molecule of chlorinated aluminum phthalocyanine (this invention).

DETAILED DESCRIPTION OF THE INVENTION

The chlorinated aluminum phthalocyanine represented by the formula, $AlC_{32}N_8H_{(17-x)}Cl_x$(wherein x=1.0~3.0), and used in the present invention can be easily synthesized by subjecting orthophthalodinitrile and aluminum chloride to a condensation reaction in the absence of a solvent under application of heat. The chlorinated aluminum phthalocyanine obtained by this reaction is refined by being repeatedly washed with an organic solvent and water. It is further refined by sublimation to expel a slight amount of residual impurities which have survived the repeated washing. The product of this final refining is put to use. For the specific chlorinated aluminum phthalocyanine to be used effectively as a charge generating agent in an electrophotographic photoconductor contemplated by this invention, it is only required to be treated with a water-containing organic solvent or water. This specific compound of the formula, $AlC_{32}N_8H_{(17-x)}Cl_x$ (wherein x=1.0~3.0), produces its effect invariably so long as the variable, x, of this formula has a number in the range of 1.0 to 3.0.

Figure 1:
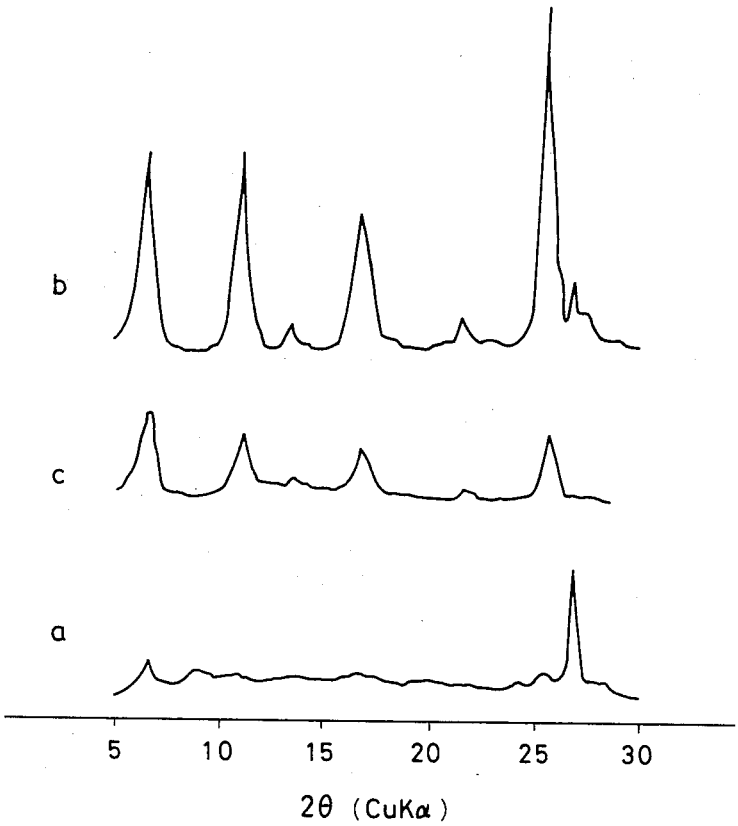
FIG. 1 is an X-ray diffraction spectrum of a chlorinated aluminum phthalocyanine of the formula, $AlC_{32}N_8H_{(17-x)}Cl_x$ (x=1.0 to 3.0), obtained using CuKα ray as the ray source.

The chlorinated aluminum phthalocyanine which has undergone the treatment with the water-containing organic solvent, without reference to the amount of water contained in the organic solvent shows strong diffraction peaks (2θ) at 6.7 degrees, 11.2 degrees, 16.7 degrees, and 25.6 degrees as found in the X-ray diffraction spectrum given in FIG. 1, indicating that this compound has a crystal form changed from that which existed immediately after the aforementioned refinement by sublimation. When the organic solvent to be used for the aforementioned treatment contains water in an amount of less than 2 molecules per molecule of the chlorinated aluminum phthalocyanine, the phthalocyanine obtained by the treatment fails to permit the production of a sensitive material of sufficiently high performance because the loss of weight by heating on a thermobalance (produced by Seiko Electronic Industry Co., Ltd. and marketed under product code "TG/DTA 30") at a temperature increasing rate of 5° C./min. from 140° to 220° C. is less than 5.5% of the charged weight.

Figure 2:
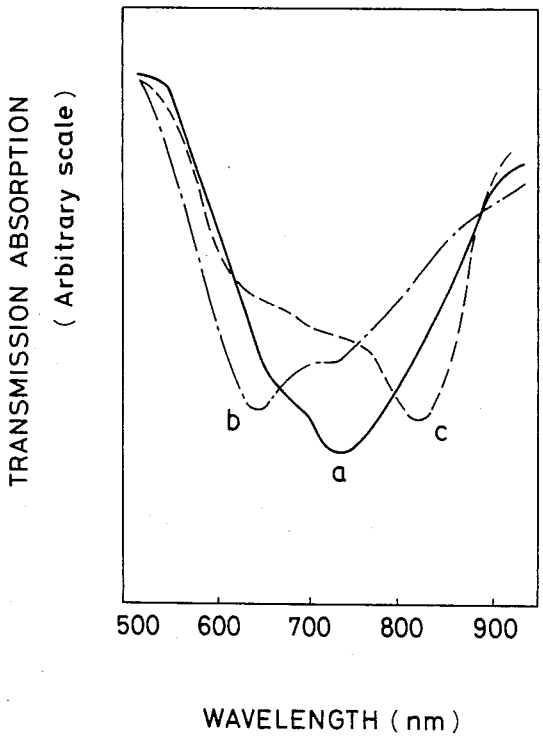
FIG. 2 is a visible absorption spectrum of the same chlorinated aluminum phthalocyanine, FIG. 3 a graph showing the results of a thermobalance analysis of the product of Example 1, and FIG. 4 a graph showing the spectral sensitivity of the photoconductor.

It has been found that this loss of weight on heating can be controlled by the amount of water contained in the organic solvent. To be specific, the loss of weight of the phthalocyanine on heating falls in the range of 6.0±0.5% by weight and the visible absorption spectrum of the compound shows the maximum absorption in the range of 750 nm to 850 nm as shown in FIG. 2 and the produced sensitive material acquires a quality for high performance only when the organic solvent to be used for the treatment of the chlorinated aluminum phthalocyanine contains water in an amount of not less than 2 molecules per molecule of the chlorinated aluminum phthalocyanine.

The organic solvent to be used in the water-containing organic solvent treatment is desired to possess affinity for chlorinated aluminum phthalocyanines and does not show very high solvent action. Examples of the organic solvent meeting this requirement include toluene, xylene, ethyl acetate, dichloromethane, chloroform, chlorobromomethane, and nitroethane. Such organic solvents as methanol, ethanol, and tetrahydrofuran are not desirable because they have such high degrees of solvent action that the chlorinated aluminum phthalocyanine is prevented from acquiring an effective crystal form.

The amount of water contained in the water-containing organic solvent is required to be not less than 2 molecules per molecule of the chlorinated aluminum phthalocyanine. If the amount of water is more than that required for saturation of the organic solvent and, therefore, exists in the form of water drops in the organic solvent, the excess water brings about no enhancement of the effect of the addition of water. Thus, it is important that the amount of the organic solvent and the amount of the chlorinated phthalocyanine to be treated should be adjusted so that the amount of water contained will not exceed the level for saturation of the solvent. When the treatment with the solvent is carried out under the conditions described above, the loss of weight of the chlorinated aluminum phthalocyanine on heating will not exceed 6.5% by weight.

The treatment of the chlorinated aluminum phthalocyanine with the water-containing organic solvent contemplated by the present invention is effected by using, for example, as the water-containing organic solvent, chloroform containing therein 2 molecules of water per molecule of chlorinated aluminum phthalocyanine and pulverizing the chlorinated aluminum phthalocyanine powder refined by sublimation together with the water-containing organic solvent for at least 10 hours in a ball mill.

The chlorinated aluminum phthalocyanine obtained by the treatment using water alone without any organic solvent shows strong diffraction peaks at 6.7 degrees, 11.2 degrees, 16.7 degrees, and 25.6 degrees in the X-ray diffraction spectrum thereof as given in FIG. 1, indicating that this treatment has given the chlorinated aluminum phthalocyanine a crystal form changed from that which existed immediately after the refinement by sublimation. The chlorinated aluminum phthalocyanine obtained by this treatment has a loss of weight on heating falling in the range of 6.0±0.5% by weight similarly to the chlorinated aluminum phthalocyanine obtained by the treatment with a water-containing organic solvent. Unlike the chlorinated aluminum phthalocyanine which has not undergone the treatment, the chlorinated aluminum phthalocyanine obtained by this treatment has the maximum absorption in the range of 640 to 660 nm in the visible absorption spectrum as given in FIG. 2.

In consideration of the fact that the chlorinated aluminum phthalocyanine which has undergone the treatment using the water-containing organic solvent shows the maximum absorption at 830 nm, it is only logical to conclude that the chlorinated aluminum phthalocyanine resulting from the treatment using water alone possesses an entirely new crystal form heretofore unknown to the art.

In FIG. 1 and FIG. 2, the curve (a) represents the data obtained from samples refined by sublimation and given no further treatment (comparative experiment), the curve (b) those of samples produced by treatment with water alone (this invention), and the curve (c) those of samples produced by treatment with a water-containing organic solvent (this invention).

The treatment of the chlorinated aluminum phthalocyanine solely with water according to the present invention is effected by stirring this compound with pure water for at least 20 hours in a ball mill or by exposing the compound and water jointly to ultrasonic waves for at least 1 hour. The crystal form which the chlorinated aluminum phthalocyanine acquires as a result of the treatment with water remains without change even when the compound is treated with an organic solvent.

The use of the chlorinated aluminum phthalocyanine in the charge generating layer of the photoconductor according to this invention is made by superimposing the charge generating layer containing the compound on an electroconductive substrate. This electroconductive substrate can be formed of an electroconductive metal such as aluminum, copper, nickel, zinc, gold, or indium. Optionally, for improving the memory retaining property of the photoconductor, a layer of zinc oxide or methanol-soluble polyamide using polyvinyl alcohol as a binder may be superimposed in a thickness of not more than 1 μm on the electroconductive substrate.

The chlorinated aluminum phthalocyanine for use as the charge generating layer is obtained by pulverizing, in the aforementioned water-containing organic solvent or water held in a ball mill, the chlorinated aluminum phthalocyanine powder refined by sublimation. The obtained chlorinated aluminum phthalocyanine is applied as it is or in combination with a binding agent such as acrylic resin, styrene resin, alkyd resin, polyester resin, polyamide resin, or polycarbonate resin, on the aforementioned electroconductive substrate. Although the amount of the binding agent to be used in this case is not specifically defined, the binding agent is generally used in an amount in the range of 20 to 200 parts by weight based on 100 parts by weight of the chlorinated aluminum phthalocyanine. In this case, the charge generating layer is desired to be applied in an amount calculated to decrease, on drying, to a thickness in the range of 0.02 to 5 μm.

Subsequently, a charge transfer layer is superimposed on the above charge generating layer of chlorinated aluminum phthalocyanine to produce a photoconductor. The charge transfer layer thus superimposed on the charge generating layer is intended to transfer to the surface of the photoconductor the charge generated in the charge generating layer and, therefore, is required to be pervious to the light of the range of wavelength to which the charge generating layer is sensitive. For producing a photoconductor of optimum quality, the energy level (such as ionization potential and electron affinity) of the charge transfer layer and that of the charge generating layer must fit each other properly. The charge transfer layer can be formed using either a charge transfer agent alone or a charge transfer agent as dissolved or dispersed in a suitable resin as a binder.

Examples of the charge transfer agent to be used independently include polyesters obtained from 2,6-dimethoxy-9,10-dihydroxy anthracene and dicarboxylic acids, polyethers obtained from 2,6-dimethoxy-9,10-dihydroxy anthracene and dihalogen compounds, and polyvinyl carbazoles. Examples of the charge transfer agent to be used as dispersed in the resin binder include anthracenes such as 2,6,9,10-tetraisopropoxy anthracene, oxadiazoles such as 2,5-bis(4-diethylaminophenyl)-1,3,4-oxadiazole, pyrazoline derivatives such as 1-phenyl-3-(p-diethylaminostyryl)-5-(p-diethylaminophenyl)-pyrazoline, styryl compounds such as 4-(diethylamino)-styryl-2-anthracene, and hydrazone type compounds such as p-diethylaminobenzaldehyde-(diphenyl hydrazone).

Examples of the resin binder for the charge transfer agent include polyvinyl chloride, polycarbonate, polystyrene, polyester, styrene-butadiene copolymer, polyurethane, and epoxy resins. The binder resin is used in an amount falling in the range of 60 to 200 parts by weight based on 100 parts by weight of the charge transfer agent. In this case, though the thickness of the charge transfer layer is not specifically defined, the charge transfer layer desirably has a thickness in the range of 6 to 20 μm by reason of the relationship with the potential to be received.

This invention will be described more specifically below with reference to working examples and comparative experiments.

The quality of a given photoconductor was evaluated with a tester, Model SP 428, produced by Kawaguchi Elecric, specifically corona charging a sample photoconductor at −5.5 KV, measuring the surface potential of the sample,t hen irradiating this sample with a monochromic light of a luminous energy of 3.84 $\mu W/cm^2$, clocking the time required for the surface potential to decrease to ½ of the original magnitude and accordingly determining the exposure energy, $E(\frac{1}{2})(\mu J/cm^2)$, and then clocking the time required for the surface potential to decrease to 1/5 of the original magnitude and accordingly determining the exposure energy, $E(1/5)(\mu J/cm^2)$.

EXAMPLE 1

Figure 3:
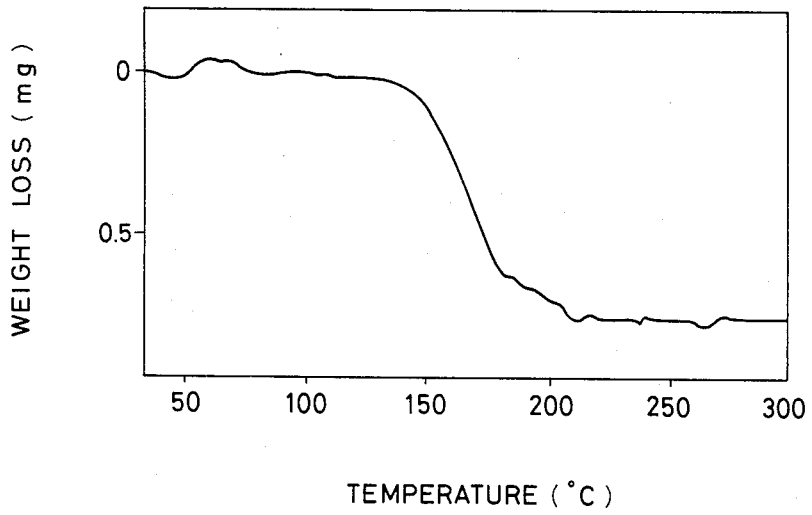
Figure 4:
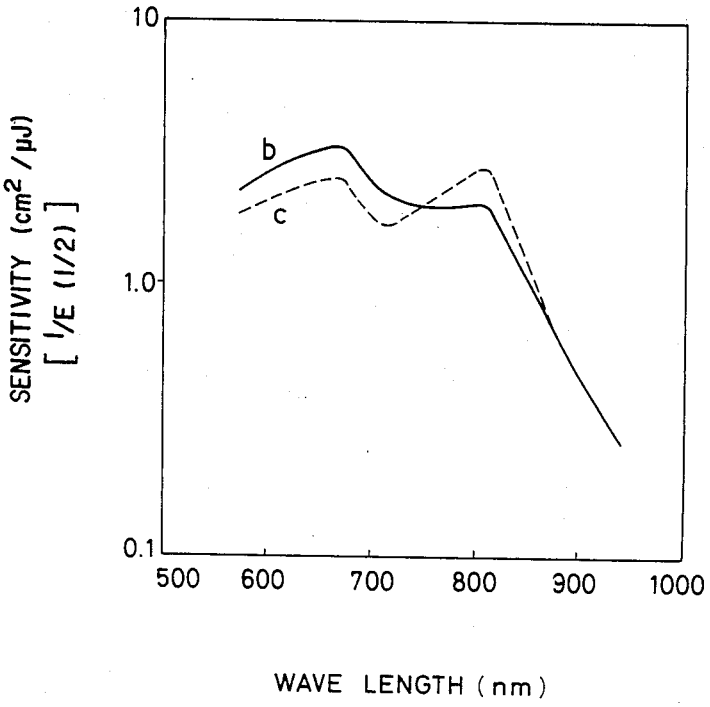

In a vacuum dried glass ball mill, 563 parts by weight of chloroform containing 8 parts by weight of chlorinated aluminum phthalocyanine of the formula, $AlClC_{32}N_8H_{15.6}Cl_{0.4}$, refined by sublimation and 0.5 part by weight of water (containing 2 molecules of water per molecule of the chlorinated aluminum phthalocyanine) was blanketed with nitrogen and pulverized therein at room temperature for 10 hours. Of the dispersion consequently obtained, 1 part by weight was spread dropwise on a transpartent quartz plate 1 mm in thickness and 15 parts by weight was dried with a current of nitrogen gas and further vacuum dried at 60° C. for 12 hours, to prepare specimens for measurement of visible absorption spectrum and for determination loss of weight on heating with a thermobalance. The visible absorption spectrum was measured in the range of 500 to 900 nm with a recording spectrophotometer (produced by Hitachi Ltd. and marketed under the product code "330"). The loss of weight on heating from 140° to 220° C. was determined with a thermobalance (a combination differential thermal analyzer and thermogravimeter produced by Seiko Electronic Industry Co., Ltd. and marketed under the product code "TG/DTA 30") under a current of argon gas at a temperature increasing rate of 5° C./min from 30° to 300° C. as shown in FIG. 3. The results are shown in Table 1.

In the remaining 550 parts by weight of the dispersion, 8 parts by weight of acrylic resin (produced by Dai-Nippon Ink & Chemicals, Inc. and marketed under trademark designation "Acryldick A-801") was dissolved. The resulting coating liquid was applied by immersion on an aluminum sheet 100 μm in thickness in such an amount as to decrease, on drying, to a thickness of 0.1 μm. The applied layer was dried at 100° C. for 1 hour, to produce a charge generating layer. On this charge generating layer, a solution prepared by adding 700 parts by weight of trichloropropane to 100 parts by weight of a polyester obtained from 2,6-dimethoxy-9,10-dihydroxy anthracene and dodecanoic acid and homogenizing the resulting mixture at 90° C. was applied in an amount such as to decrease, on drying, to 15 μm. The applied layer of the mixture was dried at 100° C. for 1 hour to produce a charge transfer layer. Thus, a photoconductor was completed. This photoconductor was tested for properties. The results are shown in Table 2.

EXAMPLE 2

The procedure of Example 1 was repeated, except that 563 parts by weight of chloroform containing 0.56 part by weight of water was used in place of the chloroform containing 0.5 part by weight of water. The results are shown in Table 1 and Table 2.

COMPARATIVE EXPERIMENTS 1-3

The procedure of Example 1 was repeated, except that 563 parts by weight of chloroform containing 0.12 part by weight of water (the amount which provides 0.5 molecule of water per molecule of chlorinated aluminum phthalocyanine represented by $AlClC_{32}N_8H_{15.6}Cl_{0.4}$) in Comparative Experiment 1, 0.24 part by weight of water (the amount which provides one molecule of water per molecule of the same phthalocyanine) in Comparative Experiment 2, or 0.35 part by weight of water (the amount which provides 1.5 molecules of water per molecule of the same phthalocyanine) in Comparative Experiment 3 was used in the place of the chloroform containing 0.5 part by weight of water. The results are shown in Table 1 and Table 2.

EXAMPLE 3

The procedure of Example 1 was repeated, except that 560 parts by weight of distilled water was used in the place of 563 parts by weight of chloroform containing 0.5 part by weight of water. The results are shown in Table 1 and Table 2.

TABLE 1

| | Amount of sample placed on thermobalance (mg) | Loss of weight from 140° to 220° C. (mg) | Ratio of loss of weight (%) | Maximum absorption wavelength (nm) in absorption spectrum |
|---|---|---|---|---|
| Example 1 | 14.3 | 0.80 | 5.60 | 774 |
| Example 2 | 17.1 | 1.10 | 6.43 | 753 |
| Comparative Experiment 1 | 17.1 | 0.25 | 1.46 | 895 |
| Comparative Experiment 2 | 18.6 | 0.53 | 2.85 | 878 |
| Comparative Experiment 3 | 15.8 | 0.67 | 4.24 | 860 |
| Example 3 | 19.9 | 1.25 | 6.58 | 650 |

TABLE 2

| | Surface Potential (V) | E (½) (μJ/cm²) | E (1/5) (μJ/cm²) | Wavelength (nm) |
|---|---|---|---|---|
| Example 1 | 580 | 0.68 | 1.6 | 800 |
| Example 2 | 575 | 0.66 | 1.5 | 800 |
| Comparative Experiment 1 | 600 | 0.72 | 6.6 | 800 |
| Comparative Experiment 2 | 585 | 0.71 | 3.3 | 800 |
| Comparative Experiment 3 | 580 | 0.70 | 2.2 | 800 |
| Example 3 | 620 | 0.32 | 1.0 | 670 |

When the samples from the foregoing working examples and comparative experiments were subjected to actual printing, those of Comparative Experiments 1-3 produced picture images containing foggings on white backgrounds because of large values of E(1/5) and those of Examples 1, 2, and 3 produced picture images free from fogging.

EXAMPLE 4

The procedure of Example 1 was repeated, except that a film obtained by dissolving copolyamide (produced by Toray Industries, Inc. and marketed under the product code "CM4001") in methanol thereby forming a methanol 1 wt % copolyamide solution, applying this solution on an aluminum sheet 100 μm in thickness by immersion in a thickness of 0.8 μm on a dry basis, and drying the applied layer was used as a substrate in the place of the aluminum sheet. The properties of the produced photoconductor at 800 nm are shown below.
Surface potential: 575 V
E(½): 0.67 μJ/cm²
E(1/5): 1.6 μJ/cm².

EXAMPLE 5

A photoconductor was produced by following the procedure of Example 4, except that a film 12 μm in thickness obtained by preparing a solution consisting of 10 parts by weight of p-diethylaminobenzaldehyde (diphenyl hydrazone), 10 parts by weight of polycarbonate resin (produced by Teijin Chemical Co., Ltd. and marketed under the trademark designation "Panligh L-1250"), and 400 parts by weight of 1,2-dichloroethane, applying this solution on the charge generating layer formed in advance, and vacuum drying the applied layer was used as a charge transfer layer in place of the polyester obtained from 2,6-dimethoxy-9,10-dihydroxy anthracene and dodecanoic acid. The properties of the photoconductor at 800 nm are shown below.
Surface potential: 600 V
E(½): 0.70 μJ/cm²
E(1/5): 1.50 μJ/cm².

EXAMPLE 6

The procedure of Example 5 was repeated, except that a chlorinated aluminum phthalocyanine of the formula, $AlClC_{32}N_8H_{16}$, refined by sublimation was used in the place of the chlorinated phthalocyanine represented by the formula, $AlClC_{32}N_8H_{15.6}Cl_{0.4}$. This phthalocyanine showed the maximum absorption at 760 nm in the visible absorption spectrum. A sample 16.6 mg in charge weight, when heated on a thermobalance, showed a loss of 0.98 mg from 140° to 220° C., indicating the ratio of loss of weight on heating to be 5.90%. The properties of the photoconductor at 800 nm are shown below.
Surface potential: 580 V
E(½): 0.70 μJ/cm²
E(1/5): 1.6 μJ/cm².

EXAMPLE 7

The procedure of Example 5 was repeated, except that a chlorinated alumin phthalocyanine of the formula, $AlClC_{32}N_8H_{14.2}Cl_{1.8}$, refined by sublimation was used in place of the chlorinated aluminum phthalocyanine of the formula, $AlClC_{32}N_8H_{15.6}Cl_{0.4}$. This phthalocyanine showed the maximum absorption at 840 nm in the visible absorption spectrum. A sample 18.8 mg in charge weight, when heated on a thermobalance, showed a loss of 1.04 mg from 140° to 220° C., indicating the ratio of loss of weight on heating to be 5.53%. The properties of the photoconductor at 800 nm are as follows.
Surface potential: 610 V
E(½): 0.70 μJ/cm²
E(1/5): 1.7 μJ/cm².

EXAMPLE 8

In a glass ball mill, 8 parts by weight of a chlorinated aluminum phthalocyanine of the formula, $AlClC_{32}N_8H_{15.6}Cl_{0.4}$, refined by sublimation and 1 part by weight of pure water were sealed and pulverized for 40 hours. The resulting dispersion and a solution obtained by dissolving 8 parts by weight of acrylic resin (produced by Dai-Nippon Ink & Chemicals, Inc. and marketed under the trademark designation "Acryldick A-801") in 560 parts by weight of chloroform were pulverized for one hours. On an aluminum sheet 100 μm in thickness having a copolyamide (produced by Toray Industries, Inc. and marketed under product code "CM 4001") spread thereon in a thickness of 0.8 μm on a dry basis, the coating liquid consequently obtained was applied by immersion in an amount calculated to decrease, on drying, to a thickness of 0.1 μm, to produce a charge generating layer. On this charge generating layer, the same charge transfer layer as used in Example 5 was superimposed to complete a photoconductor. The properties of the photoconductor at 670 nm are as shown below.
Surface potential: 620 V
E(½): 0.33 μJ/cm²
E(1/5): 1.2 μJ/cm².

EXAMPLE 9

In a glass ball mill, 8 parts by weight of a chlorinated aluminum phthalocyanine of the formula, $AlClC_{32}N_8H_{14.2}Cl_{1.8}$, refined by sublimation and 560 parts by weight of pure water were sealed and pulverized for 40 hours. On an aluminum sheet 100 μm in thickness having a copolyamide (produced by Toray Industries, Inc. and marketed under product code "CM 4001") applied thereon in a thickness of 0.8 μm on a dry basis, the resulting dispersion was applied by immersion in an amount calculated to decrease, on drying, to 0.1 μm, to produce a charge generating layer.

On this charge generating layer, a solution prepared by adding to 700 parts by weight of trichloropropane 100 parts by weight of a polyether obtained from 2,6-dimethoxy-9,10-dihydroxy anthracene and dibromodecane and homogenizing the resulting mixture by heating at 90° C. was applied hot in an amount calculated to decrease, on drying, to 15 μm. The applied layer was dried at 100° C. for 1 hour to form and charge transfer layer and complete a photoconductor. The properties of this photoconductor at 670 μm are as follows:
Surface potential: 570 V
E(½): 0.4 μJ/cm²
E(1/5): 1.5 μJ/cm².

EXAMPLES 10–13

Photoconductors were prepared by following the procedure of Example 5, except that 10 parts by weight of 2,6,9,10-tetraisopropoxy anthracene (Example 10), 10 parts by weight of 2,5-bis-(4-diethylaminophenyl)-1,3,4-oxadiazole (Example 11), 10 parts by weight of 1-phenyl-3-(p-diethylaminostyryl)-5-(p-diethylaminophenyl)-pyrazoline (Example 12), and 10 parts by weight of 4-(diethylamino)-styryl-2-anthracene (Example 13) were used severally as a charge transfer agent in the place of 10 parts by weight of p-diethylaminobenzaldehyde-(diphenylhydrazone). The properties of photoconductors at 800 nm are as shown below.

| Example | Surface potential (V) | E (½) (μJ/cm²) | E (1/5) (μJ/cm²) |
|---|---|---|---|
| 10 | 560 | 1.00 | 1.9 |
| 11 | 605 | 1.11 | 2.0 |
| 12 | 550 | 0.55 | 1.3 |
| 13 | 570 | 0.67 | 1.5 |

What is claimed is:

1. A layered photoconductor comprising a charge generating layer and a charge transfer layer superimposed on an electroconductive substrate, which photoconductor has as the main component of said charge generating layer an aluminum phthalocyanine derivative defined by the following requirements:

(a) that said derivative is a chlorinated aluminum phthalocyanine represented by the formula, $AlC_{32}N_8H_{(17-x)}Cl_x$ (wherein x represents a number in the range of 1.0 to 3.0), (b) that the weight on heating (the ratio of weight lost by heating on a thermobalance at a temperature increasing rate of 5° C./min. from 140° to 220° C. to the weight prior to heating) is 6±0.5% by weight, (c) that the X-ray diffraction spectrum shows strong diffraction peaks at the Bragg angles of 6.7 degrees, 11.2 degrees, 16.7 degrees, and 25.6 degrees, and (d) that the visible absorption spectrum shows the maximum absorption in a wavelength range of 640 nm to 660 nm or 750 nm to 850 nm.

2. A photoconductor according to claim 1, wherein said charge transfer layer contains at least one compound selected from the group consisting of polyesters produced from 2,6-dimethoxy-9,10-dihyroxyanthracene and dicarboxylic acids, polyethers produced from 2,6-dimethoxy-9,10-dihydroxyanthracene and dihalogen compounds, polyvinyl carbazoles, anthracene derivatives, oxadiazole derivatives, pyrazoline derivatives, styryl compounds, and hydrazone derivatives.

3. A photoconductor according to claim 1, wherein said chlorinated aluminum phthalocyanine is prepared by subjecting orthophthalodinitrile and aluminum chloride to a condensation reaction in the absence of a solvent under application of heat, refining the resulting compound by repeatedly washing with an organic solvent and water, further refining by sublimation, and treating the refined compound with a water-containing organic solvent or water.

4. A photoconductor according to claim 1, wherein said charge generating layer is a compound obtained by adding a binding agent in an amount in the range of 20 to 200 parts by weight to 100 parts by weight of said chlorinated aluminum phthalocyanine.

5. A photoconductor according to claim 1, wherein said electroconductive substrate is an electroconductive metal.

* * * * *